US007073564B2

(12) United States Patent
Kroos et al.

(10) Patent No.: US 7,073,564 B2
(45) Date of Patent: Jul. 11, 2006

(54) SYSTEM FOR HOMOGENIZING A MOLTEN METAL FILM

(75) Inventors: Joachim Kroos, Meine (DE); Karl-Heinz Spitzer, Clausthal-Zellerfeld (DE); Ulrich Urlau, Moers (DE)

(73) Assignees: SMS Demag AG, Düsseldorf (DE); Salzgitter AG, Salzgitter (DE)

( * ) Notice: Subject to any disclaimer, the term of this patent is extended or adjusted under 35 U.S.C. 154(b) by 440 days.

(21) Appl. No.: 10/371,046

(22) Filed: Feb. 20, 2003

(65) Prior Publication Data

US 2003/0155097 A1 Aug. 21, 2003

Related U.S. Application Data

(63) Continuation of application No. 09/646,326, filed as application No. PCT/DE99/00589 on Mar. 1, 1999, now Pat. No. 6,581,674.

(30) Foreign Application Priority Data

Mar. 17, 1998 (DE) ..... 198 11 434

(51) Int. Cl.
*B22D 11/00* (2006.01)

(52) U.S. Cl. ..... 164/423; 164/415

(58) Field of Classification Search ..... 164/463, 164/479, 473, 475, 477, 443, 444, 485, 489, 164/437, 415, 423, 429
See application file for complete search history.

(56) References Cited

U.S. PATENT DOCUMENTS 4,791,979 A * 12/1988 Liebermann ..... 164/463
5,000,250 A * 3/1991 Feuerstacke ..... 164/449.1
5,230,381 A * 7/1993 Nara et al. ..... 164/463
5,253,699 A * 10/1993 Solignac et al. ..... 164/463
5,538,071 A * 7/1996 Johansson et al. ..... 164/479
6,581,674 B1 * 6/2003 Kroos et al. ..... 164/463

FOREIGN PATENT DOCUMENTS

WO WO-9523661 A1 * 9/1995

* cited by examiner

*Primary Examiner*—Kevin P. Kerns
(74) *Attorney, Agent, or Firm*—Cohen, Pontani, Lieberman & Pavane

(57) ABSTRACT

A method and apparatus for making a molten film of metal, in particular a steel film, more uniform by strip casting, in which the molten material which is applied to a revolving belt is to have a thickness and properties which are as uniform as possible across the width of the film. To make the film more uniform over its width, forces are introduced into the metal film with a component which is directed oppositely to the direction in which the film is conveyed, which forces make the profile of the molten film of metal more uniform.

1 Claim, 1 Drawing Sheet

SYSTEM FOR HOMOGENIZING A MOLTEN METAL FILM

CROSS-REFERENCE TO RELATED APPLICATION(S)

This application is a continuation of U.S. patent application Ser. No. 09/646,326, now U.S. Pat. No. 6,581,674, filed Nov. 28, 2000 based on an International application filed on Mar. 1, 1999.

BACKGROUND OF THE INVENTION

The invention relates to a method for making a molten film of metal, in particular a steel film, more uniform, and to a device for carrying out the method.

The invention can be employed wherever a molten film of metal, in particular of steel, is applied to a substrate, in particular to a revolving conveyor belt, in molten form and its thickness and properties are to be as uniform as possible over the width of the strip.

During the strip casting of metal, in particular of steel, the cast thickness of the strip can to a large extent be selected optimally according to the required thickness during finish rolling and for the necessary hot forming to achieve sufficient materials properties. It is known to cool the molten metal using suitable methods and devices in such a way that the surface of the liquid strand of metal is cooled uniformly by contact with an inert gas.

DE 44 07 873 C2 describes a method and a device for cooling molten steel, in which nozzles are directed onto the surface of the steel strand at an angle of between 0 and 50° in the direction of casting, with the result that the steel surface is cooled uniformly and in a controlled manner. This makes it possible to avoid any scaling and to achieve controlled dissipation of heat, with the result that the surface tension is influenced in a controlled way and the desired quality of the steel strand or steel strip is achieved. However, a constant thickness also remains important to the quality of a strip made from steel with a view to achieving uniform materials properties over the width of the strip, and this cannot readily be achieved simply by applying the molten steel to the conveyor belt.

Therefore, the object of the invention is to improve the prior art in such a way that it becomes possible to alter a film of molten metal before and after it comes into contact with the conveyor belt, so that it has a uniform thickness with uniform materials properties over its width.

SUMMARY OF THE INVENTION

To make the film of metal applied to the casting belt more uniform over its width, the solution according to the invention envisages forces being introduced, making the molten metal more uniform.

For the invention, it is advantageous for these forces to be introduced into the film of metal across the width of the strip in the opposite direction to the direction in which it is conveyed. For this purpose, the molten material flowing onto the conveyor belt should be decelerated by the action of the forces. If the molten film is flowing more quickly than the conveyor belt, the cross section which is taken up by the molten material is smaller than the cross section of the molten film moving synchronously with the conveyor belt (desired cross section). An insufficiently filled cross section of this nature represents a drawback. Decelerating and building up the molten material leads to the cross section being filled up uniformly. Excessive deceleration and an oversized molten film is to be avoided. Unlike in DE 44 07 873 C2, it is the geometric uniformity, even if it is achieved by means of a gas stream, rather than the cooling which is the principal factor. Accordingly, there are significant different features for the gas flow. Furthermore, force components which act perpendicularly to the surface assist with making the cross section more uniform.

It is advantageous for these forces to be applied oppositely to the direction in which the strip is conveyed by a gas stream directed onto the strip. Suitable gases are inert gases, such as argon or nitrogen, if appropriate with the addition of reducing components, for example $H_2$, CO, or oxidizing components which have an effect on the surface tension, such as $O_2$, $CO_2$.

Furthermore, it is advantageous for the gas to be applied to the film of metal at equal distances. This can be achieved by a row of nozzles which are arranged next to one another and are operated in such a way that the volumetric flow rate of gas flowing out exerts a force on the surface of the film of liquid metal. This force leads to the gas jets penetrating into the metal film to an extent of at least 50% of the thickness of the metal film. The intensity of each gas jet must be such that the liquid metal is prevented from splashing up and dispersion of gas bubbles into the molten material is avoided.

Furthermore, it is advantageous for gas nozzles to be arranged next to and behind one another, so that they are, as it were, in the shape of a rake. As a result, the film of liquid metal which is being conveyed in the opposite direction to that in which the gas flows out is treated by the emerging gas jets as if by a rake, with the result that the molten material is decelerated and made more uniform over the width of the strip. It is particularly advantageous for two or more rakes to be arranged one behind the other, in each case offset, acting in the same way as a Pascal's triangle. The result is that the thickness of the strip is as uniform as possible over its width and the materials properties of the strip are as uniform as possible over the width.

Furthermore, it is advantageous for the nozzles to be arranged at an angle which is such that the gas stream impinges on the surface of the molten film oppositely to the direction of flow of the cast strip, at an angle of between 10 and 80° to the vertical. To control the thickness of the cast strip, it is furthermore advantageous for the thickness of the molten film to be determined by suitable sensors after it has been applied and for the gas flow emerging from the nozzles to be controlled by means of a suitable control device in such a way that this gas stream acts on the thickness of the strip over the width of the strip in a controlled manner.

Furthermore, it is advantageous for an agent which initiates solidification to be applied to the film of metal, in order to achieve advantageous solidification of the surface. For steel, for example, the solidification-initiating agent used is an oxidizing $CO_2$-containing gas which causes decarburization of a thin surface layer of the molten film so that the solidification temperature can be raised above the actual temperature to such an extent that the solidification starts from the top side. The $CO_2$ content must be kept sufficiently low to ensure that there is no formation of slag.

Other solidification-initiating agents which may be used include a cooling and nucleating powder, for example metal powder, a liquid slag, a gas or a further liquid metal.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
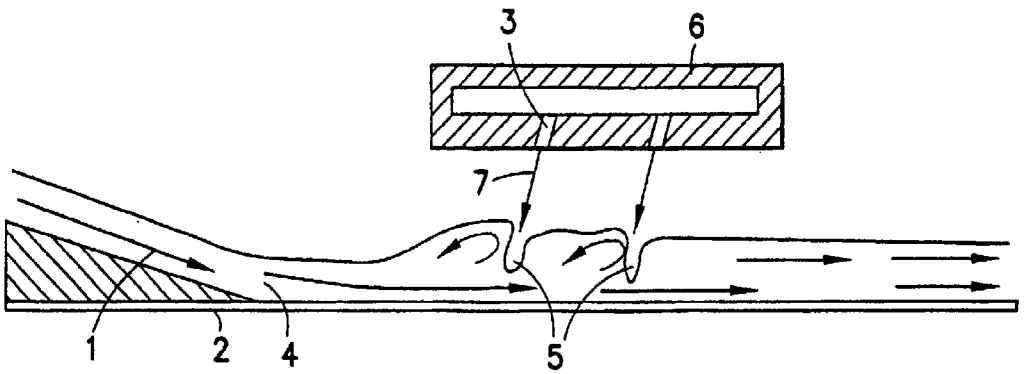
FIGS. 1 and 2 show the situation with flow modifications.
Figure 2:
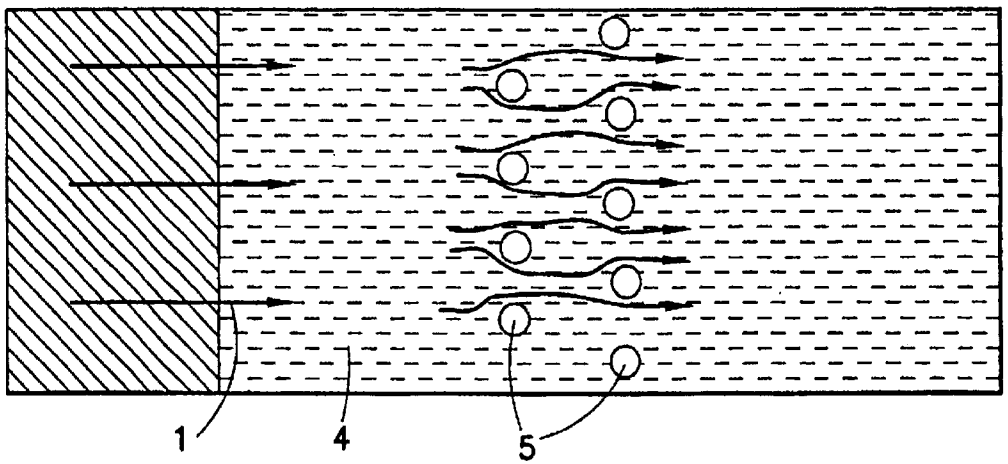

As an additional option, it is possible to use a corresponding argon rake in order to provide a uniform distribution of material as early as at the feed plane.

Furthermore, to make the film of metal 4 more uniform, it is advantageous for such argon rakes to oscillate transversely with respect to the flow of metal.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

LIST OF REFERENCE NUMERALS USED

1 Metal feed
2 Conveyor belt
3 Gas nozzle
4 Film of metal
5 Point of incidence of the gas on the film of metal
6 Copper section
7 Gas jet

What is claimed is:

1. An apparatus for making a molten film, comprising a revolving conveyor belt on which a molten metal material is applied as a film, and a plurality of gas nozzle rows arranged offset with respect to one another and arranged above the width of the film directed oppositely to the direction of movement of the conveyor belt.

* * * * *